US006758021B1

(12) United States Patent
Trangsrud

(10) Patent No.: US 6,758,021 B1
(45) Date of Patent: Jul. 6, 2004

(54) CAGE SPACER

(76) Inventor: Julian P. Trangsrud, 300 Cherry St., Northfield, MN (US) 55057

( * ) Notice: Subject to any disclaimer, the term of this patent is extended or adjusted under 35 U.S.C. 154(b) by 31 days.

(21) Appl. No.: 10/304,774

(22) Filed: Nov. 26, 2002

Related U.S. Application Data

(63) Continuation-in-part of application No. 10/224,837, filed on Aug. 21, 2002.

(51) Int. Cl.[7] ..... F16C 1/14
(52) U.S. Cl. ..... 52/655.1; 52/665; 52/719
(58) Field of Search ..... 24/339, 336; 119/452, 119/467; 52/655.1, 665, 686, 719, 648.1

(56) References Cited

U.S. PATENT DOCUMENTS 1,353,969 A * 9/1920 Mariner ..... 24/56
3,660,873 A * 5/1972 Kawashima ..... 248/222.12
4,589,794 A * 5/1986 Sugiura et al. ..... 403/187
4,655,424 A * 4/1987 Oshida ..... 248/73
4,805,479 A * 2/1989 Brightwell ..... 74/502.4
4,966,482 A * 10/1990 Fujimoto ..... 403/24
5,203,054 A * 4/1993 Arnold ..... 24/336
5,517,731 A * 5/1996 Spykerman ..... 24/295
6,354,054 B1 * 3/2002 Verelli et al. ..... 52/686

* cited by examiner

*Primary Examiner*—Carl D. Friedman
*Assistant Examiner*—Basil Katcheves
(74) *Attorney, Agent, or Firm*—Nikolai & Mersereau, P.A.

(57) ABSTRACT

A cage spacer for spacing reinforcing rods or welded fabric a specified distance from mold walls for poring concrete during construction projects. The cage spacer comprises two intersection bodies oriented perpendicular to each other and preferable with one body having a base higher than the other. A pair of pads on opposite ends of a first body base for stabilizing the body on the rebar. A pair of rebar engaging clips on opposite ends of the second body base for snapping onto and gripping a perpendicularly intersecting rebar such that the rebar is held securely in the clips. The cage spacer attaches over the intersection of a pair of rebars. At least one apex of the bodies engages a mold wall to keep the mold wall a specified distance from the rebars while concrete is being poured in the mold.

6 Claims, 4 Drawing Sheets

CAGE SPACER

This is a continuation-in-part of Ser. No. 10/224,837 filed Aug. 21, 2002.

BACKGROUND OF THE INVENTION

1. Field of the Invention

This invention relates to clip on spacers for rebars or welded fabric used in structures to space the rebars or welded fabric a specified distance from concrete mold walls.

2. Description of the Related Art

In the past concrete rebars or welded fabric have been held in place by a variety of devices. Some of the devices are for holding the rebars or welded fabric a specified distance above the ground and so have a large ground contacting area to form a stable base for holding the rebars or welded fabric up without the spacer tipping over. Other spacers are used to hold mold walls away from a lattice of intersecting rebars or welded fabric. In this use a large contact area with the wall will leave a large area of the spacer exposed when the mold is removed. The concrete is thereby prevented from filling in the volume against the mold wall in the space occupied by the spacer. It is important to have as small a footprint of the spacers at the mold so that the edges of the poured concrete has more concrete on the outer surface for greater strength and for a better appearance.

Some spacers have clip on portions where two clips on each rebar are very close together such that the spacer can twist or turn on the rebar. These spacers are thus not held sufficiently straight, resulting in variations of spacing distance between the mold wall and the rebars or welded fabric. It is important to have spacers that will stay aligned to hold the mold wall a specified distance from the rebars or welded fabric.

Some spacers have clip on connections, which can come loose during impacts received during the construction process. It is desired to have clips that will stay connected once installed on the rebars or welded fabric.

Strike Tool 31785 64$^{th}$ Ave., Cannon Falls, Minn. 55009, has a pyramid spacer with a C-shaped clip-on portion for engaging rebars.

SUMMARY OF THE INVENTION

The pyramid spacers have a pointed tip for contacting the mold walls thus leaving a small footprint on the outer portion of the poured concrete. The pyramid spacers also have a wide base with the clips spaced at the ends of the base for engaging rebars or welded fabric to provide stability against twisting forces such that the pyramid spacer remains oriented to space the rebars or welded fabric at a specified distance from the mold walls. Further the clips on the pyramid spacers have a rebar engaging portion for the rebar or welded fabric to fit into and two arms pressing on the rebar or welded fabric to lock the rebar or welded fabric snugly in place. The pyramid spacers also have a pair of pads at the corners of the base for engaging a perpendicularly crossing rebar or welded fabric to stably hold the pyramid spacers in a plane defined by the intersection of the rebars or welded fabric. Having only one pair of clips makes it easier to install the pyramid spacers.

In another embodiment the cage spacers have a trapezoid body portion and a double apex body portion with pads and clips for engaging the rebars or welded fabric. The double apex embodiment provides more stability of the cage spacer relative to the mold wall by having two contact points. In a further embodiment the cage spacer has two perpendicular double apex portions providing four apexes for engaging the mold wall and defining the plane of contact such that the cage spacer is stable on all axis against the mold wall.

OBJECTS OF THE INVENTION

It is an object of the invention to provide a spacer for spacing rebars or welded fabric a specified distance from molds.

It is an object of the invention to provide a spacer that will not come off of the rebars or welded fabric once installed.

It is an object of the invention to provide a spacer that will not twist or turn once installed which will change the distance of the rebars or welded fabric to the mold wall.

It is an object of the invention to provide a small footprint of the spacer at the mold wall.

It is an object of the invention to provide spacers with clips that are easy to install.

It is an object of the invention to provide an inexpensive, reliable and durable spacer.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
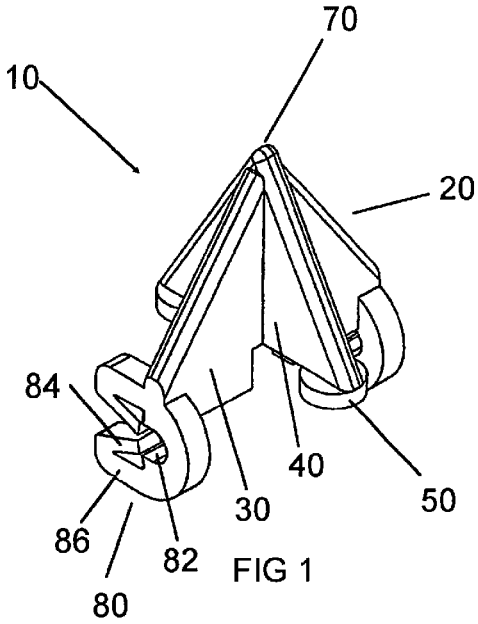
FIG. 1 is a top angled perspective view of the cage spacer with a sideways facing clip.
Figure 2:
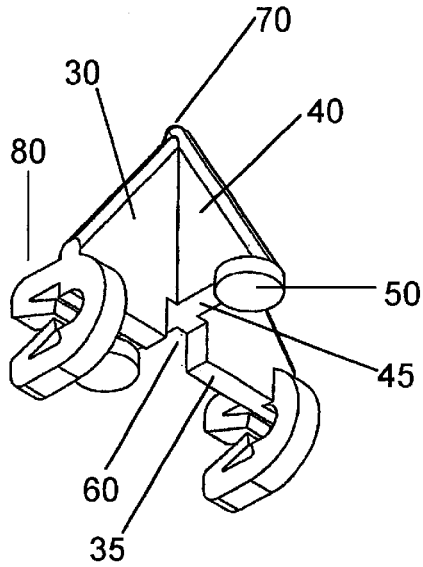
FIG. 2 is a bottom angled perspective view of the cage spacer with a sideways facing clip.
Figure 3:
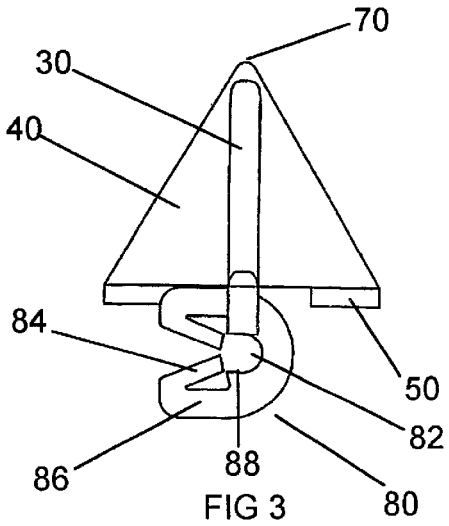
FIG. 3 is a front view of the cage spacer with a sideways facing clip.
Figure 4:
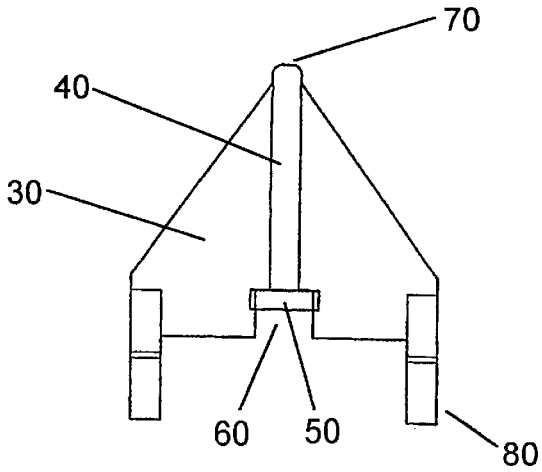
FIG. 4 is a side view of the cage spacer with a sideways facing clip.
Figure 5:
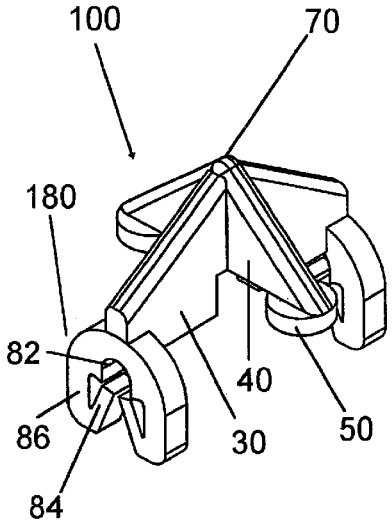
FIG. 5 is a top angled perspective view of the cage spacer with a downward facing clip.
Figure 6:
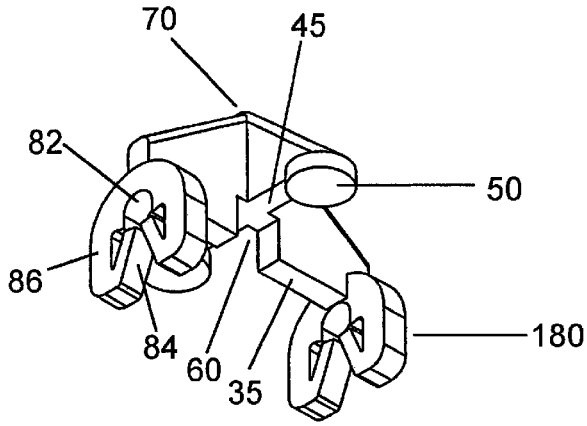
FIG. 6 is a bottom angled perspective view of the cage spacer with a downward facing clip.
Figure 7:
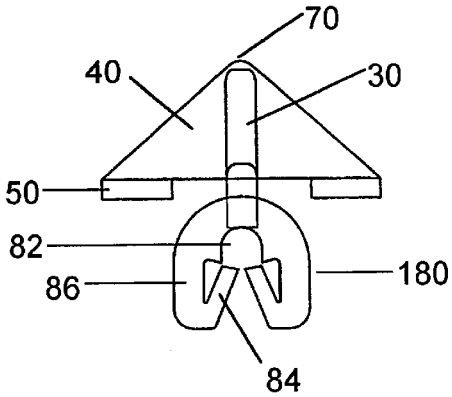
FIG. 7 is a side front of the cage spacer with a downward facing clip.
Figure 8:
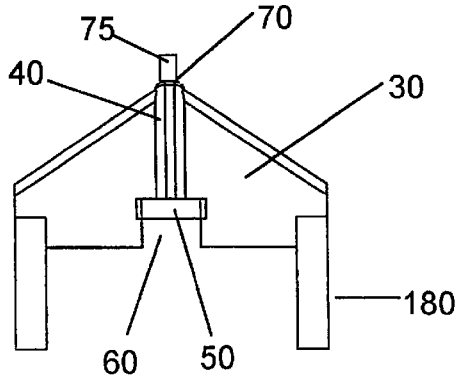
FIG. 8 is a side view of the cage spacer with a downward facing clip.

There are two cage spacer clip orientations shown in the figures. In FIGS. 1–4 the cage spacer 10 has a sideways facing clip portion 80 for engaging a reinforcing rod. In a second embodiment, shown in FIGS. 5–8, the cage spacer 100 has a downward facing clip portion 180 for engaging a reinforcing rod. In all other respects the structure of cage spacers 10 and 100 are the same in the two embodiments.

The cage spacer 10 has a pyramid portion 20 comprising two triangle body portions 30 and 40, intersecting right angles to each other and overlapping in their center portions along a common central apex axis. The triangles 30 and 40 are offset at their tips and bases such that the top of triangle portion 40 is the tip of apex 70. The tip of triangle 30 is slightly lower than the tip of triangle 40. The footprint of the apex 70 of the cage spacer 10 is thus reduced at the interface with the mold thus increasing the concrete available at the mold surface. The base 35 of triangle 30 is lower than the base 45 of triangle 40 to accommodate the difference in height of the intersecting rebars or welded fabric to which they are attached. Triangle portion 30 has the clip portions 80 attached at the comers of base 35. Triangle 40 has pad portions 50 attached at the comers of base 45 for engaging a rebar. Aperture 60 is removed from the center of triangle portion 30 at its base 35 to accommodate a rebar passing therethrough. Thus the cage spacer is designed to attach at the intersection of two rebars or at the intersection of the fabric in the welded fabric such that the cage spacer apex 70 it perpendicular to the plane formed by the intersecting rebars or of the welded fabric.

Clip 80 has a rebar engaging portion 82, two arm supporting segments 86, and two angled arms 84 angling inward from the arm supporting segments 86 toward the open end of the rebar engaging portion 82 near the center of clip 80. Clip 80 is placed on the rebar by forcing the angled arms 84 apart until the rebar rests in the rebar engaging portion 82. Then the angled arms 84 are able to spring back into their unstressed position. When the rebar is enclosed in the rebar engaging portion 82 it can not escape since arms 84 have captured it in place. Clips 80 are spaced apart at the ends of base 35 on triangular body portion 30 such that the cage spacer 10 is stabilized.

The cage spacer 10 is held securely on the plane defined by the intersecting rebars or intersecting fibers in a welded fabric by pads 50 and clips 80. The apex 70 of the pyramid is thereby held firmly so that it will always provide a specified distance from the plane of the rebars or welded fabric to the mold surface.

Clip portion 80 has arms 84 forming an entry to the rebar engaging portion 82 at a right angle to the apex axis may present a problem in that it may be difficult to force the cage spacer 10 on to the rebar or the fabric in a welded fabric from the side. It would be easier to place the cage spacer 10 on the rebars or fabric of the welded fabric at the intersection of the rebars or fabric of the welded fabric if the clip portion 80 was oriented to push straight down on the rebars or welded fabric.

In a second embodiment 100, shown in FIGS. 5–8, the cage spacer 100 has clip portion 180 rotated 90 degrees compared to the first embodiment cage spacer 10. In this embodiment the cage spacer 100 can be attached by pushing the cage spacer 100 straight down into the plane of the intersecting rebars or the intersecting fabric of a welded fabric.

There are tradeoffs between the embodiments of cage spacer 10 and cage spacer 100. In cage spacer 10 the clips 80 are at 90 degrees to the plane of the base of the pyramid and are more difficult to install over the rebars or the fabric of a welded fabric. The advantage is that the rebar engaging portion 82 has a wall engaging the rebar such that there will be very little play to move the spacer on the rebar such that the apex 70 will more reliably point perpendicular to the plane of the intersecting rebars or fabric of a welded fabric.

In the embodiment of cage spacer 100 the cage spacer is easier to install but the arms 84 may allow the cage spacer to pivot on the axis of the rebar or welded fabric due to the arms 84 not being as solid a barrier and as well positioned as the wall 88 of the clip portion 80 of cage spacer 10.

The arms 84 are designed to have their ends engage the rebar or fabric of the welded fabric at angles such that the rebar or fabric of the welded fabric is held snugly in the recess of the rebar engaging portion 82 with the ends of arms 84 blocking the escape of the rebars or fabric of the welded fabric by engaging the rebars' or fabrics' circumference.

The triangular body portions 30 and 40 do not have to be of equal heights, or have equal length bases, or equal angles. The triangles 30 and 40 may be offset in height by differing amounts. Alternatively triangular body portions 30 and 40 need not be offset at all, such that the apex of both triangles are at the apex of the pyramid. Further, a pin 75 (FIG. 8) may be extended from the apex of the higher of the pyramids to form the tip of the cage spacer and extent the height of the cage spacer while presenting a small footprint at the mold wall.

Figure 9:
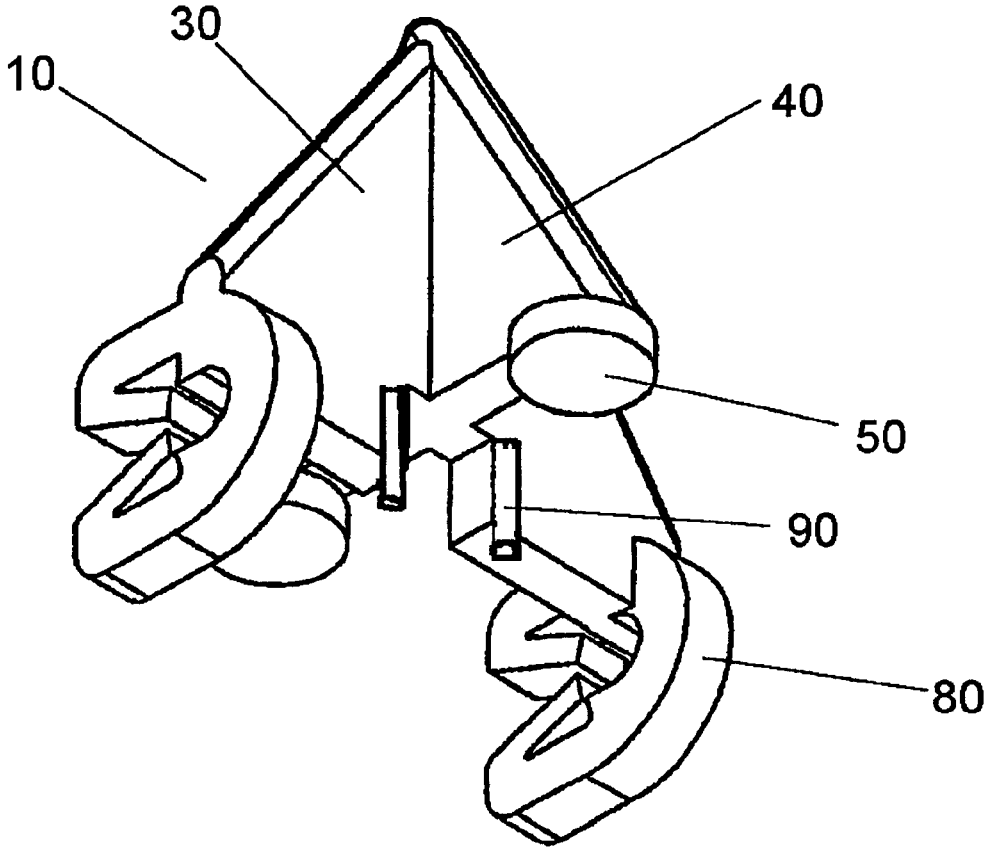
FIG. 9 is a bottom angled perspective view of the cage spacer with a sideways facing clip having rebar engaging pins.
Figure 10:
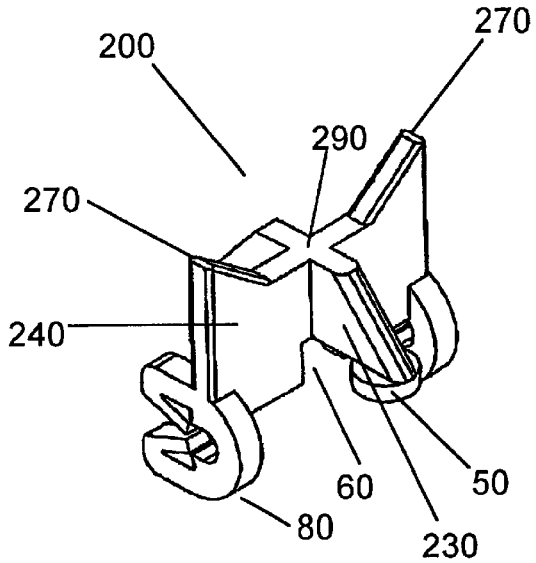
FIG. 10 is a top angled perspective view of the cage spacer having two apexes with a sideways facing clip.
Figure 11:
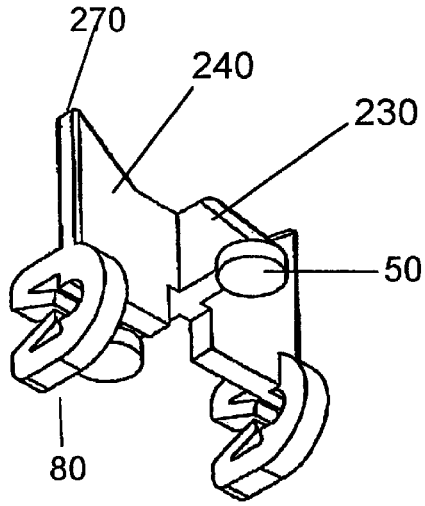
FIG. 11 is a bottom angled perspective view of the cage spacer having two apexes with a sideways facing clip.
Figure 12:
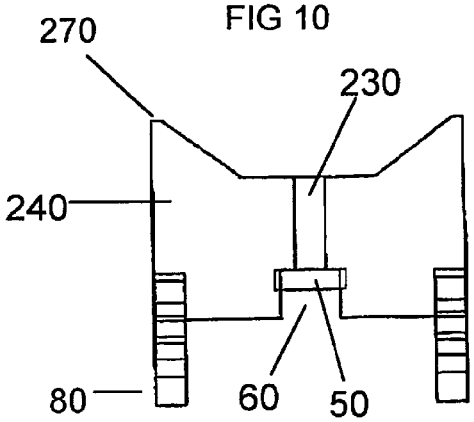
FIG. 12 is a front view of the cage spacer having two apexes with a sideways facing clip.
Figure 13:
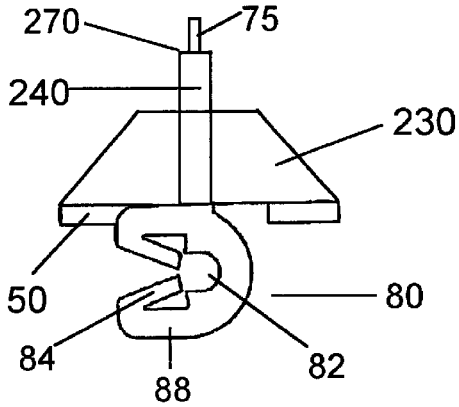
FIG. 13 is a side view of the cage spacer having two apexes with a sideways facing clip.

As FIG. 9 shows, pins 90 can be used to position the top rebar or fabric on a welded fabric between the pins 90 to align the top rebar or fabric of the welded fabric within aperture 60 and to serve as a back stop for the bottom rebar in clip portion 80. The pins 90 also align with the back portion of rebar engaging portion 82 to act as a guide for installing the cage spacer on the rebars or fabric of the welded fabric and to hold the rebars or fabric of the welded fabric in a straight line.

Although the triangular body portions 30 and 40 are shown as equilateral triangles any triangles may be used. Further, the apex and base of the first and second triangle segments can vary is as to which is has the higher apex and lower base. Alternatively, one triangle segment can have the higher apex and the lower base.

In a third embodiment 200, shown in FIGS. 10–13, the cage spacer 200 has two apexes 270 spaced apart from each other providing two points of contact with a wall for linearly aligning the cage spacer 200 with the wall on one axis. A single point of contact 70 can be tilted to the side relative the clip portions 80 whereas two points of contact form a line so that the cage spacer is not tilted on this axis. Pads 50 on cage spacer 200 are spaced apart and provide a line of contact with reinforcing rods on a perpendicular axis to the two apexes 270 in contact with the wall. In this manner the cage spacers 200 are made more stable and do not twist relative to the face of the wall due to a non exact fit of clip portion 80 on a rebar or fabric of a welded fabric.

Cage spacer 200 has a base portion the same as the base portions of cage spacers 10 and 100. Cage spacer 200 has pads 50, aperture 60, and a clip portion 80 which can be either perpendicular (as in cage spacer 10) or parallel (as in cage spacer 100) to the top to bottom axis.

Cage spacer 200 has a trapezoid portion 230 and a double apex portion 240 which are perpendicular to each other and have a plateau portion 290 at their intersection. The apexes are on opposite sides of the cage spacer to provide for stability when in contact with a wall. In another embodiment the trapezoid portion 230 can be replaced with another double apex portion 240 to provide stability in four corners so that the plane of the cage spacer is defined with respect to the wall it engages.

Cage spacer 200 may have different styles of apex portion 240 portions. As shown the apex is at the top of a triangular extension from plateau 290 however any style of height extension may be employed. Further a pin 75 may be employed to extend the apex 270 so that the pin 75 engages the wall with a smaller cross section of cement being displaced at the interface of the wall and the cage spacer.

The cage spacers 10, 100 and 200 can be made to fit various sized rebars or welded fabrics and have differing heights for spacing the mold walls at different distances from the rebars or welded fabric. Although the cage spacers are described as attaching to rebars or welded frabrics throughout the application wires or other means for making cages to support cage spacers and reinforce the concrete can be used with the cage spacers.

The cage spacers 10, 100 and 200 can each optionally have features such as the pins 75 and 90.

Obviously, many modifications and variations of the present invention are possible in light of the above teachings. It is therefore to be understood that, within the scope of the appended claims, the invention may be practiced otherwise than as specifically described.

What is claimed is:

1. A cage spacer comprising:

a trapezoid body portion having a top and a base and a double apex body portion having a top and a base wherein the body portions intersect perpendicularly at their centers, and their bases are parallel to a common plane, the base of the trapezoidal body portion having a pad at each end for engaging rebars, the base of the double apex portion having a clip portion at each end, the clip portion having a rebar engaging portion, arm support segments extending from the rebar engaging portion and opposing arms radially angled toward the center of the rebar engaging portion for capturing a rebar therein attached to the support segents, and the base of the trapezoidal body portion and the double apex portion are at different heights to accommodate the position of intersecting rebars.

2. A cage spacer as in claim 1 wherein, the rebar engaging portions are oriented parallel to the axis of the intersecting bodies.

3. A cage spacer as in claim 1 wherein, the rebar engaging portions are oriented perpendicular to the axis of the intersecting bodies.

4. A cage spacer as in claim 1 wherein, the base of the double apex body portion having an aperture therethrough at the intersection of the double apex body portion for allowing a rebar to pass therethrough.

5. A cage spacer as in claim 1 wherein, a pin extends from the apexes to increase the distance to a mold wall and reduce the footprint of the cage spacer on the mold wall.

6. A cage spacer as in claim 4 wherein, pins adjacent each side of the aperture on the base of the double apex body portion and extending lower than the base, the pins circumference for engaging the rebars on a line parallel to the back of the rebar engaging portion to retain the rebars.

* * * * *